US005081774A

United States Patent [19]

Kuwano

[11] Patent Number: 5,081,774

[45] Date of Patent: Jan. 21, 1992

[54] COMPOSITE EXCAVATING TOOTH

[75] Inventor: Yukimitsu Kuwano, Niihama, Japan

[73] Assignee: Sumitomo Heavy Industries Foundry & Forging Co., Ltd., Ehime, Japan

[21] Appl. No.: 511,864

[22] Filed: Apr. 10, 1990

[30] Foreign Application Priority Data

Dec. 27, 1988 [JP] Japan ..... 63-327757

Related U.S. Application Data

[63] Continuation of Ser. No. 315,091, Feb. 24, 1989, abandoned.

[51] Int. Cl.[5] ..... E02F 9/28

[52] U.S. Cl. ..... 137/142 R; 299/79; 29/527.5; 29/530; 428/614

[58] Field of Search ..... 37/141 T, 142 R; 299/79; 175/410, 411; 29/527.1, 527.2, 527.3, 527.5, 530; 164/98; 428/614

[56] References Cited

U.S. PATENT DOCUMENTS

| | | | |
|---|---|---|---|
| 2,155,215 | 4/1939 | Beament | 428/614 X |
| 2,861,908 | 11/1958 | Mickelson | 37/142 R |
| 3,805,423 | 4/1974 | Engel et al. | 37/142 R |
| 3,970,445 | 7/1976 | Gale et al. | 37/142 R X |
| 3,984,910 | 10/1976 | Helton et al. | 29/530 X |
| 4,187,626 | 2/1980 | Greer et al. | 37/141 R |
| 4,608,318 | 8/1986 | Makrides et al. | 428/614 X |
| 4,704,251 | 11/1987 | Kraemer | 417/17 |
| 4,711,503 | 12/1987 | Berchem et al. | 299/79 |
| 4,817,743 | 4/1989 | Greenfield et al. | 175/411 |
| 4,885,214 | 12/1989 | Trenkler et al. | 428/614 |

FOREIGN PATENT DOCUMENTS

| | | | |
|---|---|---|---|
| 5169041 | 11/1948 | Japan . | |
| 49-5202 | 1/1974 | Japan . | |
| 49-86223 | 8/1974 | Japan . | |
| 53-100603 | 9/1978 | Japan . | |
| 54-75801 | 6/1979 | Japan . | |
| 54-152301 | 11/1979 | Japan . | |
| 56-122436 | 9/1981 | Japan . | |
| 57-2804 | 1/1982 | Japan . | |
| 59-218255 | 12/1984 | Japan . | |
| 61-190353 | 11/1986 | Japan . | |
| 62-15336 | 4/1987 | Japan . | |
| 62-99527 | 5/1987 | Japan . | |
| 1158101 | 7/1969 | United Kingdom | 37/142 |

*Primary Examiner*—Randolph A. Reese
*Assistant Examiner*—Arlen L. Olsen
*Attorney, Agent, or Firm*—Armstrong, Nikaido, Marmelstein, Kubovcik & Murray

[57] ABSTRACT

A replaceable composite excavating tooth for excavating earth comprises wear-resistant material having a higher hardness than a tooth body and being insert-cast into the tooth body. The performance of the excavating tooth is improved by locating the wear-resistant material as an integral insert at a central part between the top and bottom surfaces and determining the width of the insert substantially the same as the width between both side surfaces of the tooth body, extending the insert from the tip end toward an attachment part of the tooth and terminating the insert at a position of limit of potential use for replacing the composite excavating tooth.

8 Claims, 3 Drawing Sheets

COMPOSITE EXCAVATING TOOTH

This application is a continuation of application Ser. No. 315,091 filed Feb. 24, 1989, now abandoned.

BACKGROUND OF INVENTION

1. Field of the Invention

The present invention relates to a tooth for excavating, such as a bucket-tooth, ripper-point and the like for construction machinery. In particular, the present invention relates to a composite tooth, in which wear-resistance is selectively imparted to a part thereof required to have such property, for example a tip end.

2. Description of Related Arts

In construction machinery for excavating earth, such as a hydraulic shovel, bulldozer, or the like, a bucket tooth or a ripper point as shown in FIGS. 10 and 11 is temporarily mounted on the front end of a bucket and a ripper, respectively. Since this kind of bucket-tooth and ripper-point is subjected to severe friction and hence is seriously damaged by wear, they are generally constructed as replaceable parts. However, working efficiency is reduced, and hence the cost for parts are increased, when replacement is carried out frequently. Various improvements have therefore heretofore been devised so as to minimize replacements.

The first improvement is to enhance the wear-resistance of the mother material, i.e., the excavating tooth itself. The wear-resistance of the mother material is enhanced by means of hardening it. The toughness is however reduced to soften the material against impact. Wear-resistance can also be enhanced by adding an alloy element(s) to the mother material. Production cost is, however, considerably enhanced. In addition, when the mother material is to be produced by casting, there is a limit on the content of alloying elements, since casting becomes difficult when these elements exceed a certain limit.

The improvements which have been devised next are to selectively impart wear-resistance to a part of the mother material. The following methods are proposed as examples.

(A) A hole(s) is preliminarily formed on the mother material. It is then set in a mold. Molten metal with high wear-resistance is then poured into the hole(s) of the mother material set in a mold (Japanese Unexamined Patent Publication No. 49-86223). Metallic material having high wear-resistance is surface-welded on the mother material having good weldability (Japanese Unexamined Patent Publication No. 53-100603).

(B) An inserting hole(s) is preliminarily formed on the mother material, and, then a tip(s) of cemented carbide having high wear-resistance is embedded in the insert hole(s) (Japanese Unexamined Utility Model Publication No.49-5202, U.S. Pat. No. 805423, and Japanese Unexamined Patent Publications Nos.5452301, and 62-99527).

(C) A plurality of blank materials, each with different compositions, are successively laminated and integrally bonded with one another (Japanese Unexamined Utility Model Publication No. 51-69041 and Japanese Unexamined Patent Publication No. 56-122436).

(D) Particles or pieces of cemented carbide are insert-cast in the tip end or as a whole of the excavating tooth, so that the particles and the like are dispersed in the cast iron or steel (Japanese Unexamined Patent Publication Nos. 57-2804 and 54-75801, and Japanese Unexamined Utility Model Publication No. 61-190353).

(E) A preliminarily shaped, wear-resistant member is located in a mold. The mother material is then melted and poured around the wear-resistant member so as to insert-cast the latter in the former. The wear-resistant member is located in the mold in such a manner that at least a part of the member is exposed on the surface of the mother material (Japanese Examined Utility Model Publication No. 62-15336, and Japanese Unexamined Patent Publication No. 59-218255).

The excavating tooth produced by the pouring or surface-welding of item (A) and by the embedding of item (B) exhibit poor adhesion between the mother material and wear-resistant material. The wear-resistant material falls down during use of the excavating tooth.

In order to produce the excavating tooth by lamination and bonding by item (C) above, many man hours are required, and heat treatment is necessary for relieving welding stress and the like.

Regarding the excavating tooth produced by insert-casting the wear-resistant material in a dispersed state as is referred to in item (D), above, the particles and the like of cemented carbide are exposed and easily separated from the tooth, as it is worn out with use. The properties of cemented carbide particles embedded thus therefore cannot be taken advantage of.

Regarding the excavating tooth, in which the wear-resistant material is insert-cast and is exposed on the surface as is referred to in item (E), above, since the cooling speed of the melt of cast mother material is different between the surface and center, fusion bonding between the mother material and the wear-resistant material becomes poor, and further, the wear-resistant material is liable to crack due to thermal expansion and shrinkage. Particularly, in Japanese Unexamined Patent Publication No. 59-218255, the wear-resistant material in the form of a rod is embedded in a direction perpendicular to the longitudinal direction of the excavating tooth. The wear-resistant material is therefore subjected to bending force under excavation. There is hence danger that the material may be broken. In addition, when the tip end is worn down beyond a certain point, the rod protrudes at the tip end and is suspended or falls down. In Japanese Examined Utility Model Publication No. 62-15336, the embedded wear-resistant members are provided with a plurality of extensions which are elongated from a central wear-resistant member in upper and lower directions or from an upper wear-resistant member in a lower direction. If the difference in the wear-resistance between the wear-resistant material and mother material in this excavating tooth is very great, only the wear-resistant material is left not worn out and forms unevenesses on the tip end along the width of the tooth. In this state, the excavating resistance is increased, and, the convex parts, which are left not worn out, are subjected to bending and may be broken.

SUMMARY OF THE INVENTION

It is a general object of the present invention to provide an improved composite tooth for excavating earth, in which the wear-resistant material is insert-cast in the mother material (hereinafter simply referred to as the composite excavating tooth).

It is an object of the present invention to provide a composite excavating tooth, in which the fusion bonding between the wear-resistant material and mother material is enhanced and further, these materials wear during use while maintaining a smooth integral tapered wedge-shape.

In accordance with the objects of the present invention, a replaceable composite excavating tooth for excavating earth is provided, wherein a wear-resistant material having a higher hardness than the tooth body is insert-cast into the tooth body. Further, said tooth body consists of cast metal and has top and bottom surfaces tapered toward a tip end thereof, said wear-resistant material is located as an integral insert in a central part between said top and bottom surfaces, which insert has a width substantially the same as the width between both side surfaces of the tooth body, and which insert extends from said tip end toward an attachment part of the tooth and ends at a predetermined position for replacing the composite excavating tooth.

According to the present invention, the wear-resistant material is insert-cast at a central part of the composite excavating tooth. The wear-resistant material is therefore completely embedded in the mother material, thereby forming a monolithic structure of these materials. In addition, the wear-resistant material does not crack due to thermal expansion and shrinkage. The wear-resistant material is located at a central part of the composite excavating tooth as seen in the side view and extends virtually straight. The composite excavating tooth therefore maintains a smooth wedge shape while it wears out during use. The wear-resistant material therefore neither impedes the excavating nor breaks due to the bending force applied thereto.

The present invention is hereinafter described with reference to the examples illustrated in the drawings.

DESCRIPTION OF PREFERRED EMBODIMENTS

Figure 1:
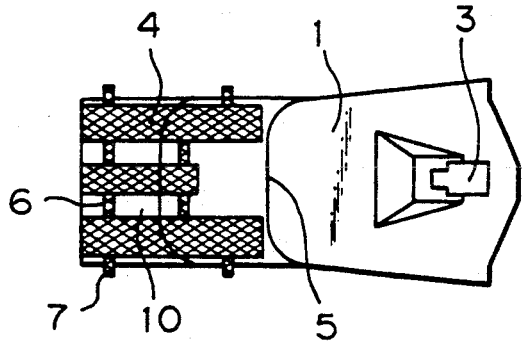
FIG. 1 is a plan view of a composite excavating tooth according to an example of the present invention.
Figure 2:
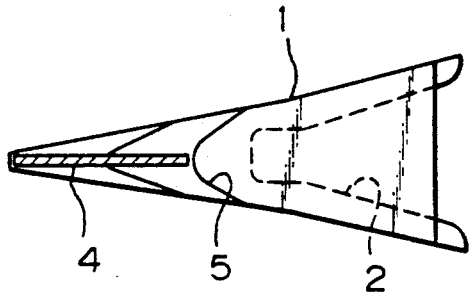
FIG. 2 is a side view of FIG. 1.

Referring to FIGS. 1 and 2, the tooth body 1 is in the form of a wedge as seen in the side view. A hole 2 is formed in the tooth body 1 at a rear end part, so as to insert a bucket, a ripper or the like (not shown) thereinto. An attachment hole 3 is formed in a direction perpendicular to the hole 2, so as to insert a fixing pin thereinto. The wear-resistant material 4, which is insert-cast at the central part of the tooth body 1, is in the form of a plurality of strips, i.e., three strips. These strips extend in the first direction from the tip end toward the attachment hole 3 and are connected with each other by anchoring rods 6 which extend in the second direction perpendicular to the first direction and consist of the same wear-resistant material 4. The strips (4) are therefore maintained by the anchoring rods 6 at a constant position during insert-casting. The strips (4) and anchoring rods 6 form an integral insert which is insert cast in the tooth body 1. The clearances 10 are formed between the strips (4) along the width of the tooth body 1. If the clearances are very narrow, the melt of mother material tends to fill them incompletely, thereby generating casting defects. In the case of casting steel, the clearance is preferably at least 5 mm. On the other hand, if the clearances 10 are very broad, the volume proportion of wear-resistant material 4 to the metal of tooth body 1 becomes small. In this case, the performance of the composite excavating tooth is not satisfactory.

The wear-resistant material is, preferably, white cast iron, high Cr cast iron, Cr-Mo cast iron or cast steel, Cr-Ni-Mo cast iron or cast steel, Cr-Mo-V cast iron or cast steel, Cr-Mo-V-W cast iron or cast steel, cemented carbides and wear-resistant ceramics, such as alumina, zirconia. The mother material, i.e., the material of the tooth body, is usually selected from cast steel, cast low-alloyed steel, or the like.

The volume proportion of wear-resistant material 4 to the mother material is preferably higher at parts near both side surfaces than at a central part of the composite excavating tooth. The width or thickness of two side strips (4) is therefore preferably greater than that of the central strip. The side edges of the tip end are highly resistant against wear and hence can have a small radius of curvature during the use of the composite excavating tooth. The excavating efficiency is therefore enhanced.

The wear-resistant material 4 has one end at the tip end and the other end at the usable limit 5 of the composite excavating tooth. The wear-resistant material 4 is provided with fixing lugs 7 for fixing the same in a mold not shown during the insert casting.

The thickness of strips (4) is preferably approximately, $\frac{2}{3}$ at tip end and approximately $\frac{1}{2}$ at the rear end of the thickness of tooth body 1.

The composite excavating teeth shown in FIGS. 3 through 9 have basically the same construction as that shown in FIGS. 1 and 2. The same constructing members as in FIGS. 1 and 2 are denoted by the same reference numerals in FIGS. 3 through 6. Only the differing points are described hereinafter with regard to FIGS. 3 through 6.

Figure 3:
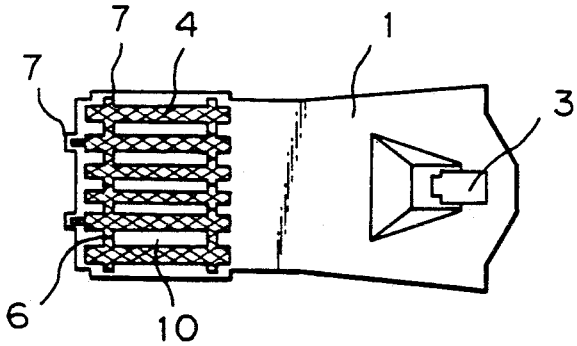
FIG. 3 is a plan view of a composite excavating tooth according to another example of the present invention.
Figure 4:
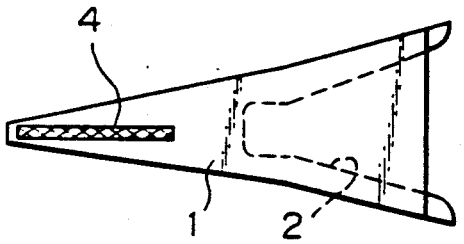
FIG. 4 is a side view of FIG. 3.
Figure 5:
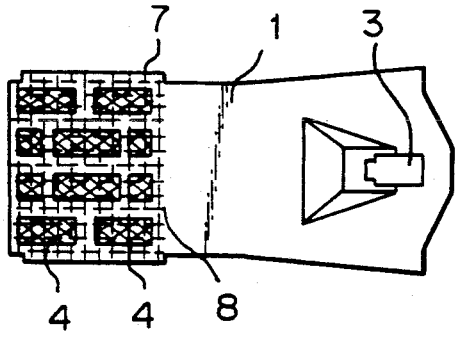
FIG. 5 is a plan view of a composite excavating tooth according to a further example of the present invention.
Figure 6:
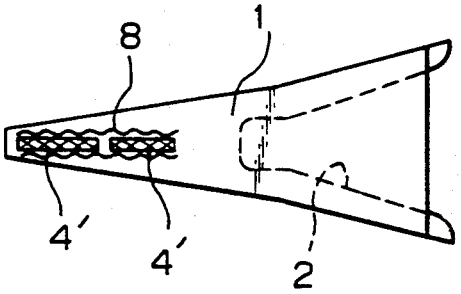
FIG. 6 is a side view of FIG. 5.
Figure 7:
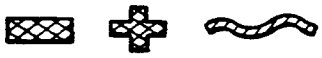
FIG. 7 schematically illustrates the shapes of wear-resistant material in the form of short pieces.
Figure 10:
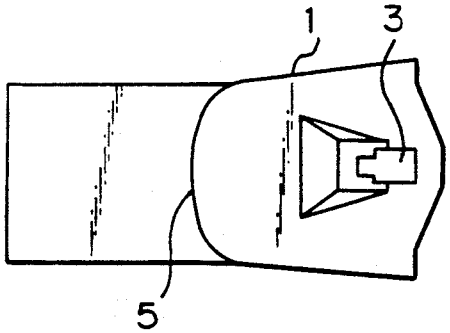
Fig. 10 PRIOR ART
FIGS. 10 and 11 are plan and side views, respectively, of a conventional excavating tooth.
Figure 11:
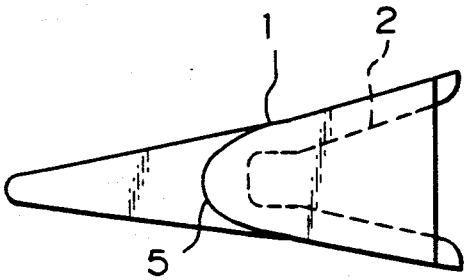
Fig. 11 PRIOR ART

In FIGS. 3 and 4, the width of clearances between the strips of wear-resistant material 4 is narrower and the number of strips is increased as compared with the example in FIGS. 1 and 2. In FIGS. 5 and 6, instead of the strips used in FIGS. 1 through 4, short pieces as shown in FIG. 7 are used for the wear-resistant material 4 and arranged in rows in the longitudinal direction of the composite excavating tooth. In order to ensure a mutual stationary position of the short pieces between them during and after the insert-casting, the short pieces are preliminarily inserted between and held by the metal meshes 8. When insert-casting, the ends of meshes 8 are held by the mold not-shown at its recess or groove provided for holding the meshes 8. The shape of short pieces may be such that the length is greater than the width, as shown in FIG. 7, for example, rectangular, long cross, and wave shapes.

Figure 8:
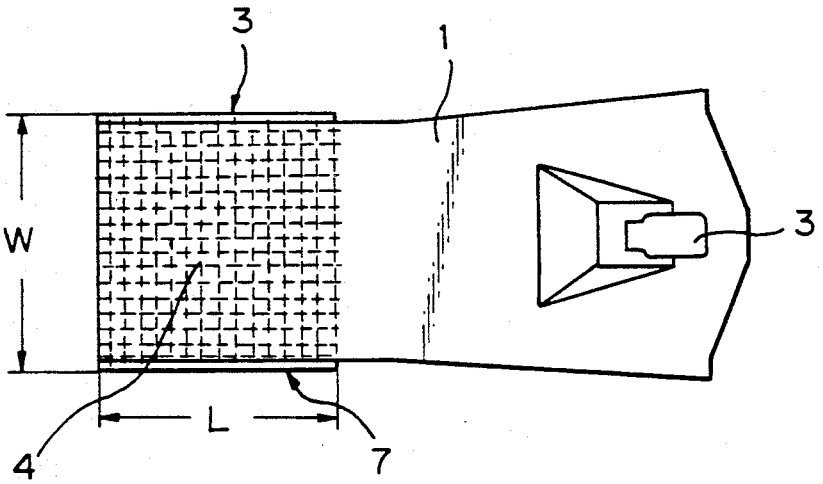
FIG. 8 is a plan view of a composite excavating tooth according to yet another example of the present invention.
Figure 9:
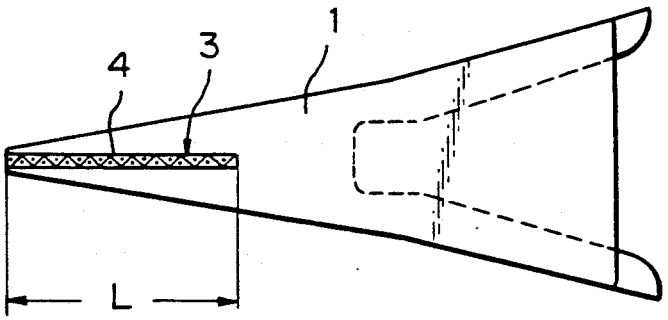
FIG. 9 is a side view of FIG. 8

Referring to FIGS. 8 and 9, the wear-resistant material 4 is in the form of a mesh. The mesh is made of piano wire, wires of stainless steel, tool steel, or wire, whose surfaces are hardened by surfacing. The width W of mesh is greater than the width of the tooth body. The protruding parts of mesh are therefore formed at both sides and are engaged with recesses, grooves or the like provided in a mold (not shown) for holding the mesh stationary during insert-casting. The length L of mesh is substantially the same as the length needed during use of the composite excavating tooth.

The wear-resistant material 4 decreases the wear of the composite excavating tooth and hence elongates its life. The shape of the tip end is not rounded during its wear, since the wear-resistant material is embedded at the center between the top and bottom surfaces and is as wide as the tooth body. The sharp edge of a tip end can therefore be maintained through the tip end, namely, front end as seen in the side view and both corner edges as seen in the plan view, during the life of a composite excavating tooth. Excavating efficiency is therefore high during the life of a composite excavating tooth.

Melt of the tooth body 1 (FIGS. 1 through 9) is usually poured into a mold (not-shown) standing from the rear and ending at the front ends of the composite excavating tooth, until the wear-resistant material 4 Is completely embedded. Then the rear part is formed by the poured melt. Melt is usually further poured to exert a hot-top effect to the melt as it solidifies in the front part of the tooth. Melt causes the melting of the surface of the wear-resistant material and leads to diffusion between the materials 1 and 4. The unmelted wear-resistant material 4 constitutes the core of the composite excavating tooth. Such a core is rigidly bonded with the tooth body via the diffusion layer as described above.

I claim:

1. A replaceable composite excavating tooth for excavating earth, comprising: a cast metal tooth body and an insert comprised of an integral body formed of a wear-resistant Cr-cast iron material having a higher hardness than said cast metal tooth body, said cast metal tooth body solidifying on said Cr-cast iron insert and having top and bottom surfaces tapered toward a tip end thereof and two side surfaces, and said Cr-cast iron insert is located at a central portion between said top and bottom surfaces of said case metal tooth body, said insert having clearances between portions of said insert which are completely filled by the solidified cast metal of said tooth body, and a width substantially the same as the width between said side surfaces of said cast metal tooth body, said insert extending from said tip end toward an attachment part of said tooth, and terminating at a predetermined useable limit of said composite excavating tooth, and said insert is rigidly and integrally bonded internally of said cast metal tooth body by a diffusion layer of materials from said cast metal tooth body and said insert between said insert and said cast metal tooth body which enhances adhesion between said insert and said cast metal tooth body and selectively imparts desired wear-resistant characteristics to said composite excavating tooth.

2. A replaceable composite excavating tooth according to claim 1, wherein said insert includes a plurality of strip-formed parts.

3. A replaceable composite excavating tooth according to claim 2, wherein said plurality of strip-formed parts extend in a first direction from said tip end toward said usable limit and are connected to each other by anchoring rods extending in a second direction perpendicular to the first direction.

4. A replaceable composite excavating tooth according to claim 3, wherein said strip-like parts are spaced from each other to provide clearances between said plurality of strip-like parts and said clearances are completely filled with the metal of said tooth body.

5. A replaceable composite excavating tooth according to claim 1 or 2, wherein a proportion of a volume of said wear-resistant material to a volume of said material of said tooth body is higher in side regions of said tooth adjacent to each of said side surfaces of said tooth than in a central region between said side surfaces of said tooth.

6. A replaceable composite excavating tooth according to claim 1, wherein said insert of Cr-cast iron material is in the form of a mesh.

7. A replaceable composite excavating toothy according to claim 1, 2, 3, 4 or 6, wherein the metal of said tooth body is cast steel.

8. A replaceable composite excavating tooth according to claim 1, 2, 3, 4, or 6, wherein the thickness of said insert of wear resistant material relative to the thickness of said tooth body is about $\frac{2}{3}$ at the tip end thereof and $\frac{1}{2}$ at said predetermined useable limit of said composite excavating tooth.

* * * * *